US005366214A

United States Patent [19]

Sato

[11] Patent Number: 5,366,214

[45] Date of Patent: Nov. 22, 1994

[54] ENCLOSURE FEED DEVICE FOR ENCLOSING AND SEALING APPARATUS AND METHOD OF ENCLOSING AND SEALING ENCLOSURES

[75] Inventor: Koki Sato, Tokyo, Japan

[73] Assignee: Juki Corporation, Chofu, Japan

[21] Appl. No.: 142,679

[22] Filed: Oct. 26, 1993

[30] Foreign Application Priority Data

Oct. 29, 1992 [JP] Japan ..... 4-291331

[51] Int. Cl.[5] ..... B65H 3/08

[52] U.S. Cl. ..... 271/100; 271/107

[58] Field of Search ..... 271/10, 11, 100, 101, 271/107

[56] References Cited

U.S. PATENT DOCUMENTS

| | | | |
|---|---|---|---|
| 4,505,470 | 3/1985 | Reinert | 271/100 |
| 4,649,691 | 3/1987 | Buckholz | 53/53 |
| 5,224,694 | 7/1993 | Magee | 271/100 |

OTHER PUBLICATIONS

*Patent Abstracts of Japan, vol. 015, No. 389 (M-1164), 2 Oct. 1991, JP-A-31 058 332, entitled "Enclosure Supply Device for Automatic Enclosing and Sealing Machine".*

*Patent Abstracts of Japan,* vol. 005, No. 162 (M-092), 17 Oct. 1991, JP-A-56 088 035, entitled "Sheet Feeder".

*Primary Examiner*—Richard A. Schacher

*Attorney, Agent, or Firm*—Fitch, Even, Tabin & Flannery

[57] ABSTRACT

The enclosure feed device is constituted in such a way that a drive motor is provided for rockably driving a rocking arm, and a control unit is provided for causing the memory section to input the variable amount relative to the sucking position of the sucking cap in conformity with the thickness of said enclosures from the variable amount inputting section and storing the same and adjusting the sucking position of said sucking cap by controllably energizing the drive motor for sucking operation in accordance with the variable amount stored in the memory by means of the CPU section.

9 Claims, 7 Drawing Sheets

| Fig. 2A | Fig. 2B |
|---|---|

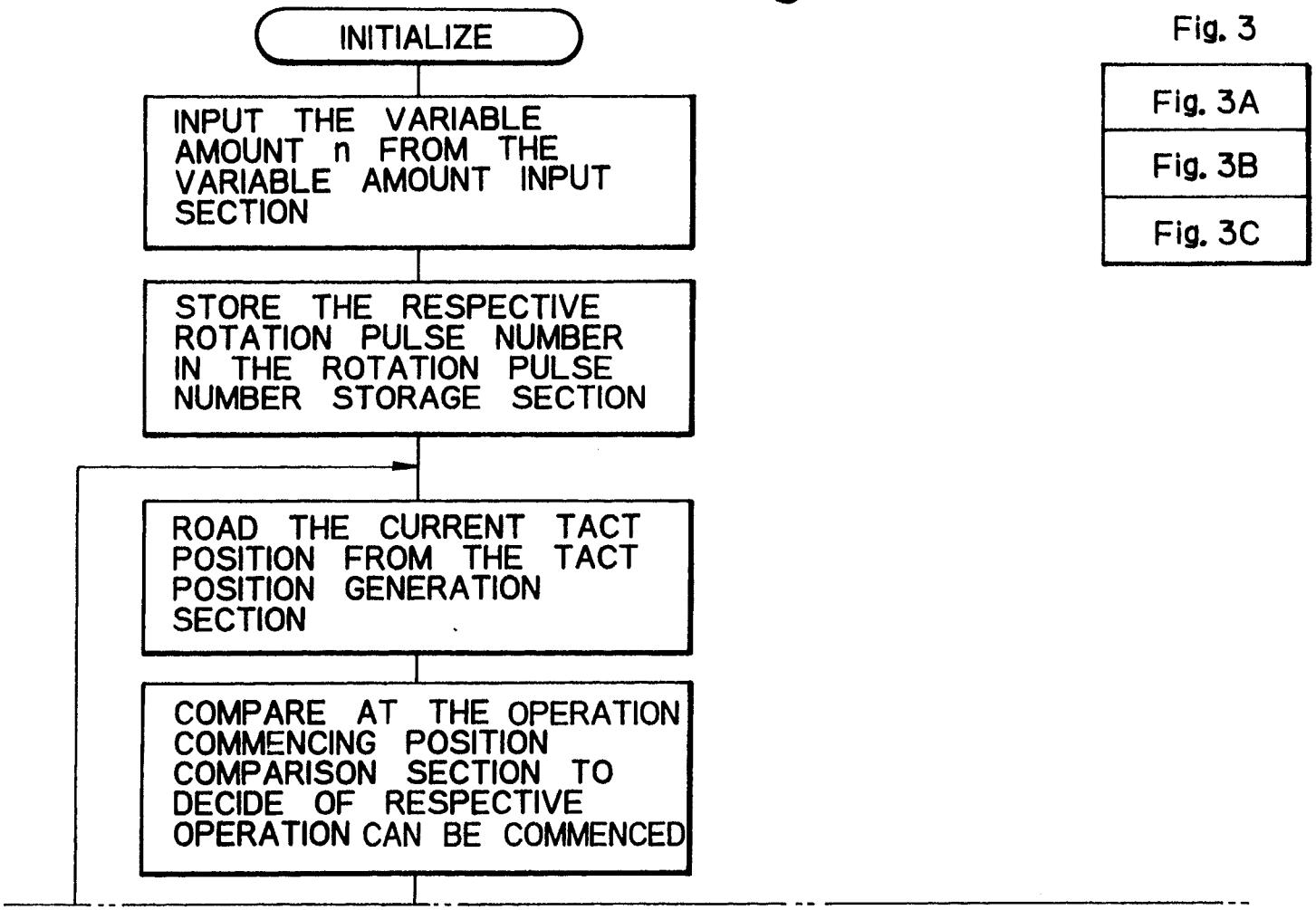
Fig. 3
Fig. 3A
Fig. 3B
Fig. 3C
Fig. 3A
INITIALIZE
INPUT THE VARIABLE AMOUNT n FROM THE VARIABLE AMOUNT INPUT SECTION
STORE THE RESPECTIVE ROTATION PULSE NUMBER IN THE ROTATION PULSE NUMBER STORAGE SECTION
ROAD THE CURRENT TACT POSITION FROM THE TACT POSITION GENERATION SECTION
COMPARE AT THE OPERATION COMMENCING POSITION COMPARISON SECTION TO DECIDE OF RESPECTIVE OPERATION CAN BE COMMENCED

ENCLOSURE FEED DEVICE FOR ENCLOSING AND SEALING APPARATUS AND METHOD OF ENCLOSING AND SEALING ENCLOSURES

BACKGROUND OF THE INVENTION

The present invention relates to an enclosure feed device for an enclosing and sealing apparatus or more particularly to an enclosure feed device for an enclosing and sealing apparatus which is adapted to automatically pick up enclosures such as brochures for the purpose of direct mail or the like one by one and supply the same to a position for enclosing.

DESCRIPTION OF PRIOR ART

A number of enclosing and sealing apparatus have been used for automatically inserting enclosures such as brochures for direct mall or the like into envelopes or the like and sealing the same. According to this sort of enclosing and sealing apparatus, there is provided an enclosure feeding device adapted to automatically pick up such enclosures one by one and feed the same to the position for enclosing it in an envelope.

FIG. 4 illustrates such an enclosure feeding device for a conventional enclosing and sealing apparatus, wherein a hopper 2 for stacking and storing specified enclosures 1 is provided, and the upper part of the hopper 2 is open while the lower surface is inclined. Downwardly of the inclined lower surface of the hopper 2 is defined a take-out opening 3 for taking out said enclosures 1 downward one by one. At the edge of said take-out opening 3, there is provided a claw 4 for separating said enclosures 1 one by one.

A rocking arm 5 is rockably provided with the rotary shaft 6 as the center at the take-out opening of the hopper 2. A sucking cap 8 mounted on the sucking cap holder 7 is attached to the tip end of the rocking arm 5. A vacuum pump not shown is connected to the sucking cap 8 and causes the sucking cap 8 to be evacuated so as to suck the underside of the enclosures contained in the hopper 2 to take them out of the take-out opening 3.

Furthermore, a follower arm 9 is attached to the rotary shaft 6 of the rocking arm 5 integrally with the rocking arm 5 and a follower roller 10 is attached to the tip end of said follower arm 9. Adjacent to the follower arm 9 there is also disposed a rocking cam 11 having a specified profile. The rocking cam 11 is rotatably driven by a drive motor (not shown) by way of the transmission belt 12. Rotation of the rocking cam 11 will cause the follower arm 9 to be rocked in accordance with the outer profile of the rocking cam 11 thereby moving the sucking cap 8 between the sucking position (or "A" position) for sucking the enclosures 1 and the feed position (or "B" position) for transferring the sucked enclosures 1.

According to the above-described enclosure feeding device of the enclosing and sealing apparatus of a prior art, specified enclosures 1 are stacked in advance in the hopper 2 and the rocking arm 5 is caused to be rocked in the clock-wise direction as viewed in FIG. 4 by causing the follower arm 9 to be rocked in accordance with the timing in relation to the movement of other members constituting the enclosing and sealing apparatus, whereby the sucking cap 8 is moved to the position for sucking the enclosures 1. Then the sucking cap 8 is operated for sucking so as suck the lowermost enclosure 1 in the hopper 2. After that the rocking arm 5 is rocked in the anti-clockwise direction as viewed in FIG. 4 so that the enclosures 1 may be taken out of the take-out opening 3 of the hopper 2 one by one.

Then, when the sucking cap 8 is moved to the position for feeding the enclosure, the sucking cap 8 is released from sucking the enclosure 1 so that the enclosures 1 may be transferred by means of a feed mechanism.

However, in such an enclosure feeding device for the conventional enclosing and sealing apparatus as above explained, if the thickness of the enclosures 1 vary, the sucking cap 8 may not be able to properly suck the enclosures 1. More specifically, if the enclosures 1 are too thin, the sucking force of the sucking cap 8 is so strong that it may pick up a plurality of enclosures 1 at the same time while if the enclosures 1 are too thick, the sucking cap may not properly suck the enclosures 1 unless the sucking cap 8 is pressed positively against the enclosures 1 prior to sucking. Thus, there was such a problem as the enclosures 1 could not always be properly fed. Furthermore, this problem occurs by material of the enclosures 1.

In view of this problem, such an enclosure feeding device has been devised as shown in FIG. 5 wherein adjustment nuts 13 are attached to the rocking arm 5 and the sucking cap 8 is screwed into the adjustment nuts 13. According to this type of the enclosure feeding device, with the adjustment nuts being loosened, the sucking cap 8 is screwed in or out. Then the adjustment nuts are tightened so that the length of the sucking cap 8 relative to the rocking arm 5 may be adjusted and a proper sucking operation of the sucking cap may be ensured depending on the thickness or quality of paper of the enclosures 1.

SUMMARY OF THE INVENTION

It is to be noted, however, that since according to the enclosure feeding device for the conventional enclosing and sealing apparatus as above explained, the length of the suction cap 8 or the sucking position of the sucking cap 8 is adjusted by manually manipulating the adjustment nuts 13, such adjustment work is quite troublesome, and the adjustment amount has to be empirically determined depending on the thickness or quality of paper of enclosures 1, resulting in difficulty in respect of attaining an accurate adjustment.

Furthermore, since it is difficult to judge the adjustment amount, it is again necessary to ascertain if an accurate adjustment is attainable or not after having operated the sucking cap 8 after adjustment, which creates a problem in terms of poor operational efficiency.

The present invention has been proposed in light of all these problems and an object of the present invention is to provide an enclosure feeding device for an enclosing and sealing apparatus which is capable of easily and accurately adjusting the sucking position of the sucking cap in accordance with the thickness or quality of paper of enclosures, significantly enhancing the adjustment work efficiency and performing a proper sucking operation.

In order to attain the object as above mentioned, the enclosure feeding device for the enclosing and sealing apparatus according to the present invention is so constructed that an enclosing and sealing apparatus comprising a rocking arm rockably arranged with a sucking cap attached to the tip end thereof adjacent a hopper for stacking and storing specified enclosures and a feed mechanism adjacent said sucking cap wherein said rocking arm is so rocked that the sucking cap is caused to suck the enclosures in the hopper one by one and transfer the same to said feed mechanism and said feed mechanism is adapted to transfer the enclosures sucked and transferred by said sucking cap to a specified position, said enclosing and sealing apparatus being characterized in further comprising a drive motor for rockably operating said rocking arm, a variable amount inputting section adapted to input variable amounts to indicate a desired sucking position in respect of the sucking cap in conforming with the thickness or quality of paper of the stacked enclosures, and a control unit adapted to activate the drive motor in accordance with the input variable amount and locating the sucking cap at the optimum sucking position in conforming with the thickness or quality of paper of enclosures and suck said enclosures one by one.

According to the enclosure feeding device for the enclosing and sealing apparatus, the variable amount in respect of the sucking position of the sucking cap in relation to the thickness of the enclosures is input from the variable amount input section and stored in the memory section and the sucking position of the sucking cap is automatically adjusted by the CPU in accordance with the variable amount stored in the memory section, such that a simple operation of inputting a particular variable amount allows the sucking cap to be adjusted to a proper sucking position in conforming with the thickness or quality of paper of an enclosure thereby significantly enhancing the adjustment work efficiency.

BRIEF EXPLANATION OF THE DRAWINGS

Embodiments of the present invention will now be explained with reference to the accompanying drawings, in which;

FIG. 3A, 3B and 3C comprise a flow diagram illustrating the control operation conducted by the control unit according to the present invention;

DESCRIPTION OF THE PREFERRED EMBODIMENTS

Figure 1:
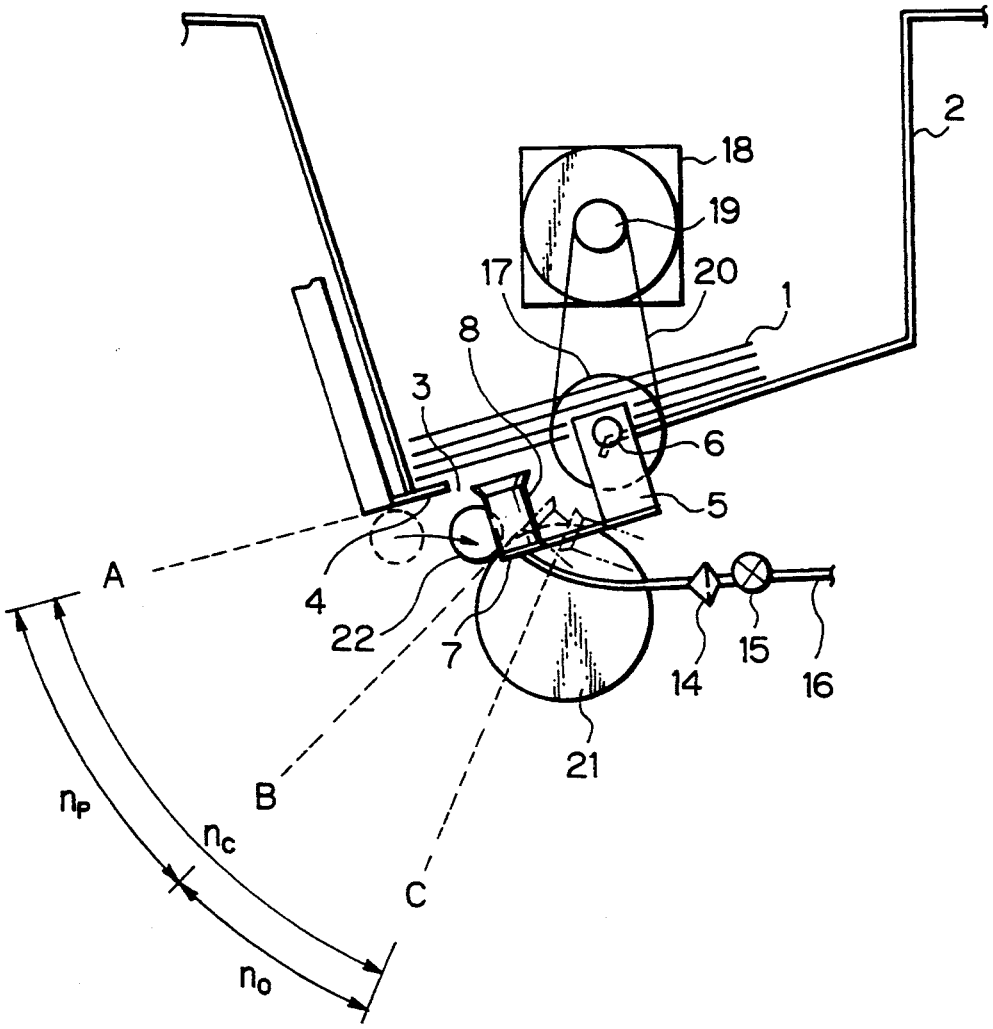
FIG. 1 is a schematic constitutional drawing illustrating an embodiment of the enclosure feeding device for the enclosing and sealing apparatus according to the present invention.

FIG. 1 illustrates an embodiment of the enclosure feeding device for the enclosing and sealing apparatus according to the present invention, wherein a hopper for stacking and storing specified enclosures 1 is provided and the upper part of the hopper 2 is open while the underside is inclined. Downwardly of the inclined underside of the hopper 2, there is defined a take-out opening 3 for taking out the enclosures 1 downwardly one by one. A claw 4 for separating the respective enclosures 1 one by one is disposed at the edge of the take-out opening 3.

A rocking arm 5 is rockably arranged with the rotary shaft 6 as the center at the take-out opening 3 of the hopper 2 and a sucking cap 8 mounted on the sucking cap holder 7 is attached to the tip end of the rocking arm 5. To the sucking cap 8, there is connected by way of the air filter 14 and the electromagnetic value 15 the vacuum pipe 16 connected to the vacuum pump not shown. By opening the electromagnetic value 15 and causing the sucking cap 8 to suck by way of the vacuum pipe 16, the underside of the enclosures 1 contained in the hopper 2 may be sucked and taken out of the take-out opening 3.

A drive pulley 17 is coaxially attached to the rotary shaft 6 of the rocking arm 5 and a drive motor 18 for sucking operation such as a stepping motor or the like is arranged adjacent to the drive pulley 17. Between the output pulley 19 of the drive motor 18 and the drive pulley 17, there is stretched a timing belt 20. Activation of the drive motor 18 for sucking operation to rockably drive the rocking arm 5 by way of the output pulley 19, the timing belt 20 and the drive pulley 17 allows the sucking cap 8 to be moved to the sucking position ("A" position) for sucking the enclosure 1, the feeding position ("B" position) for transferring the sucked enclosure 1 and the basic position (the reference position) ("C" position) where the sucking cap 1 is set back so as not to contact with the enclosure 1 while the enclosure 1 is being transferred.

A feed roller 21 is provided adjacent to the take-out opening 3 of the hopper 2 in such a manner as it is rotatably driven by a drive means such as an induction motor not shown or the like. Adjacent to the feed roller 21, there is provided a pressure contact roller 22 which is brought in contact with the feed roller 21 or spaced therefrom and cooperates with the feed roller 21 to sandwich the enclosure 1 therebetween.

Figures 2, 2A:
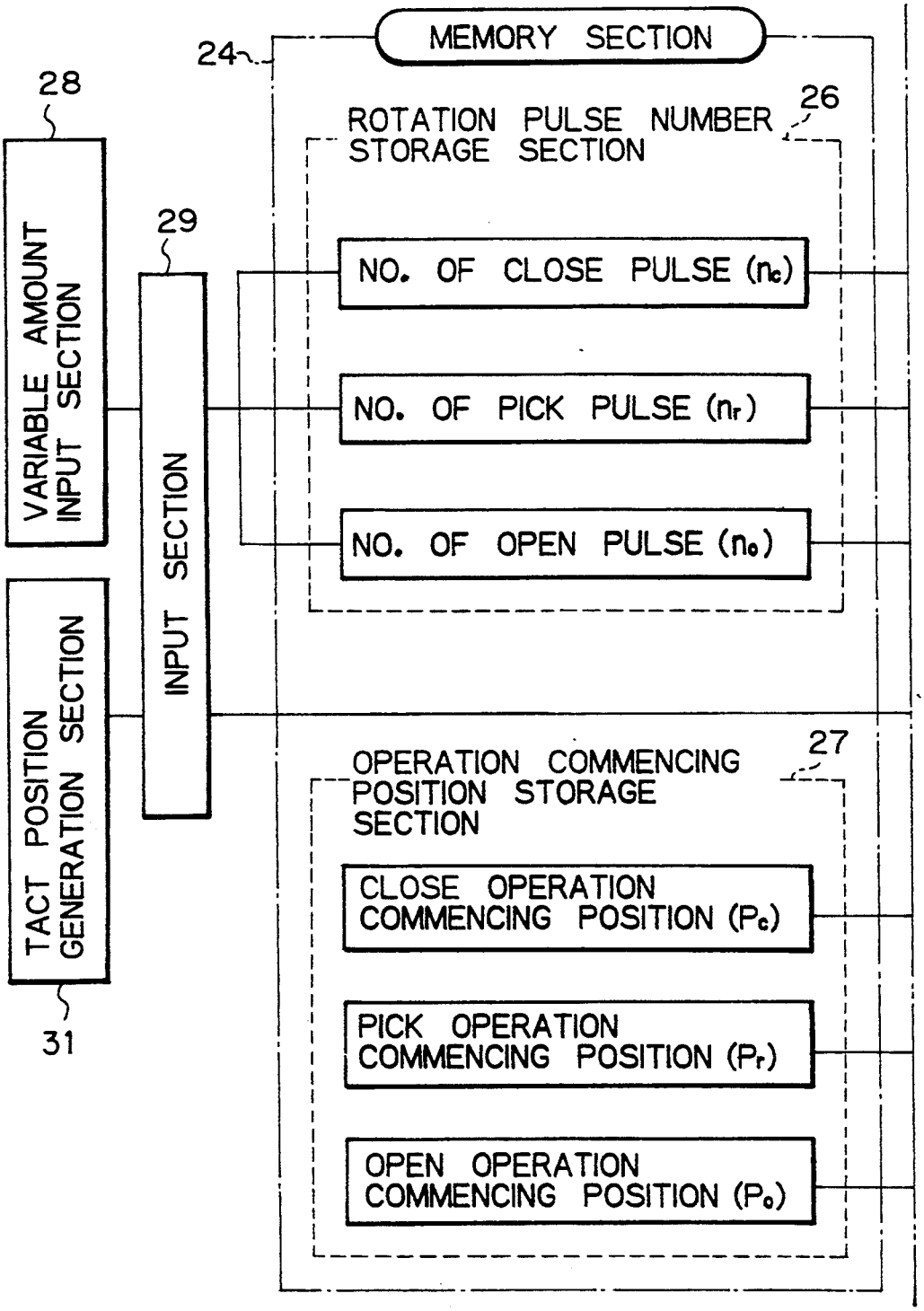
FIG. 2A and 2B comprise a block diagram illustrating an embodiment of the control unit for controlling the enclosure feeding device according to the present invention.
Figure 2B:
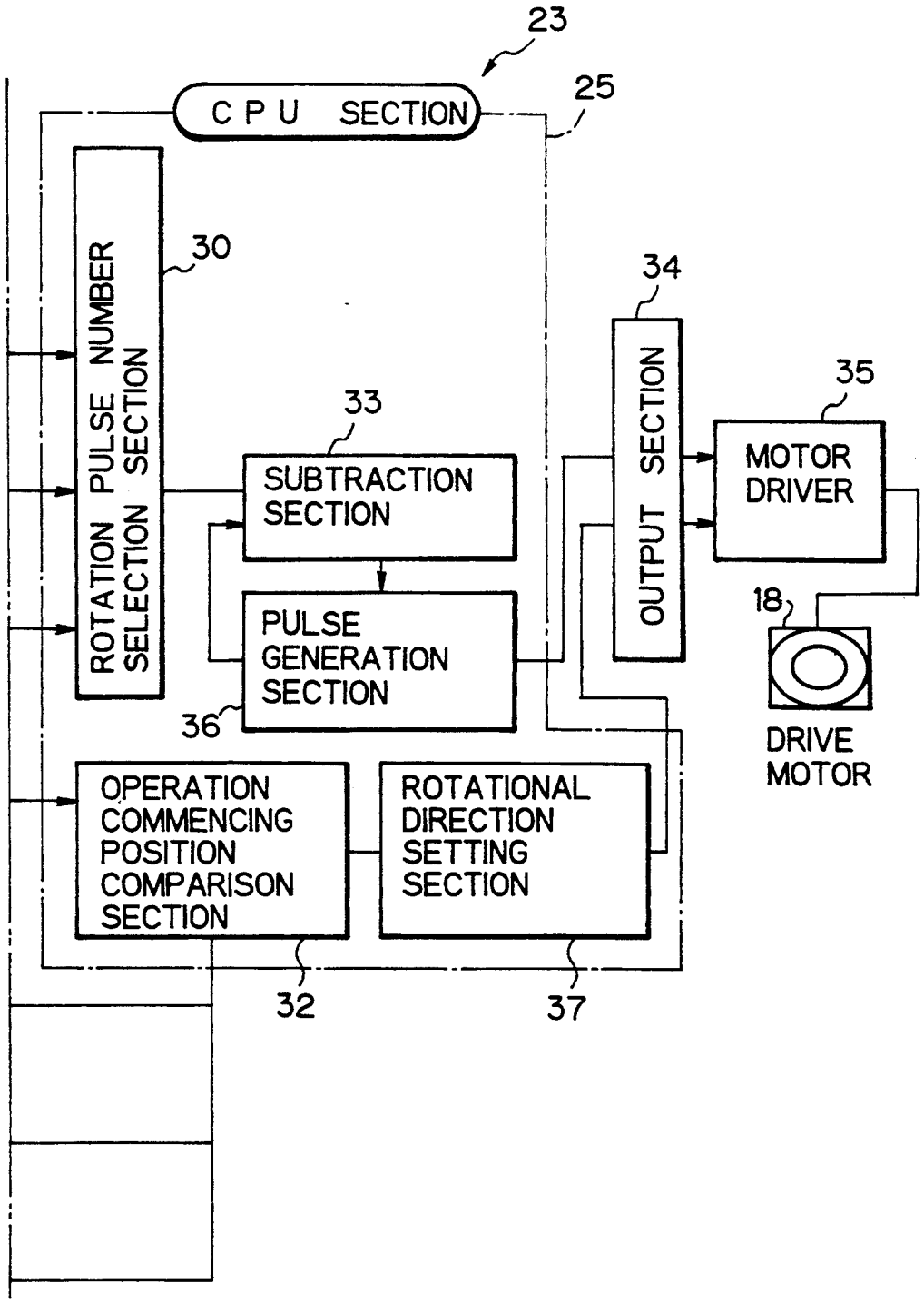

FIG. 2 illustrates an embodiment of the control unit for controlling the enclosure feeding device according to the present invention. This control unit 23 includes a memory section 24 for storing specified information and a CPU section 25 for conducting required control in accordance with the information stored in the memory section 24. The memory section 24 of the control unit 23 contains a rotation pulse number storage section 26 and an operation commencing position storage section 27. The rotation pulse number storage section 26 is adapted to store the number of "close" pulse $n_c$ necessary for conducting close operation to cause the drive motor 18 for sucking operation to be activated and the sucking cap 8 to be moved from the basic position to the sucking position, the number of "pick" pulse $n_p$ necessary for conducting pick operation to cause the sucking cap 8 to be driven from the sucking position to the feeding position and the number of "open" pulse $n_o$ necessary for conducting open operation to cause the sucking cap 8 to be driven from the feeding position to the basic position. The rotation pulse number storage section 28 is input with a particular variable amount via the input section 29 from the variable amount input section 28 arranged for example at the operational panel or the like and adapted to alter the respective numbers of the pulses as above mentioned in accordance with the input variable amount and store the same. For example, assuming that the variable amount n is the input from the variable amount :input section 28, if the initial value of the number of the close pulses is $N_c$, the number of close pulses $n_c$ will be $n_c=N_c+n$. In a similar manner the number of pick pulses $n_p=N_p+n$ and the number of open pulses $n_o=N_o$. Provided $n_c=n_p+n_o$ and $N_c=N_p+N_c$. Each of the initial values is determined based on a general-statistical value.

The operation commencing position storage section 27 is adapted to store respectively the tact position $P_c$ for commencing close operation, the tact position $P_p$ for commencing pick operation and the tact position $P_o$ for commencing open operation. The tact positions for commencing these operations respectively are those positions for commencing the respective operations in accordance with the timing relative to the operations of the other members constituting the enclosing and sealing apparatus.

In the CPU section 25, there is arranged a rotation pulse number selection section 30 adapted to read the number of pulses for the specified operation from the rotation pulse number storage section 26 and there is also in the CPU section 25, an operation commencing position comparison section 32 in which the current tact position $a_p$ of the enclosing and sealing apparatus from the tact position generation section 31 and the commencing positions of the respective operation from the operation commencing position storage section 27 are input. The operation commencing position comparison section 32 compares the current tact position $a_p$ fed from the tact position generation section 31 with the respective operation commencing positions for close, pick and open operations and when the current tact position comes to conform to the respective operation commencing positions, operation commencement enable signals are output to the rotation pulse number selection section 30.

A subtraction section 33 is connected to the rotation pulse number selection section 30, the subtraction section 33 being adapted to set in the incorporated counter not shown the number of pulses for the particular operation read from the rotation pulse number storage section 26 in accordance with the operation commencement enable signals sent from the operation commencing position comparison section 32. A pulse generation section 36 is connected to the subtraction section 33, the pulse generation section 36 being adapted to transmit a drive pulse to the motor driver 35 which controls driving of the drive motor 18 for sucking operation via the output section 34 in accordance with the signals corresponding to one pulse from the counter of the subtraction section 33 and output to the subtraction section 33 such a signal as allowing subtraction of each one pulse by the counter in the subtraction section.

Furthermore, a rotational direction setting section 37 is connected to the operation commencing position comparison section 32, the rotational direction setting section 37 being adapted to cause the motor driver 35 to set the rotational direction of the drive motor 18 based on the operation enable signal from the operation commencing position comparison section 32.

Figure 3B:
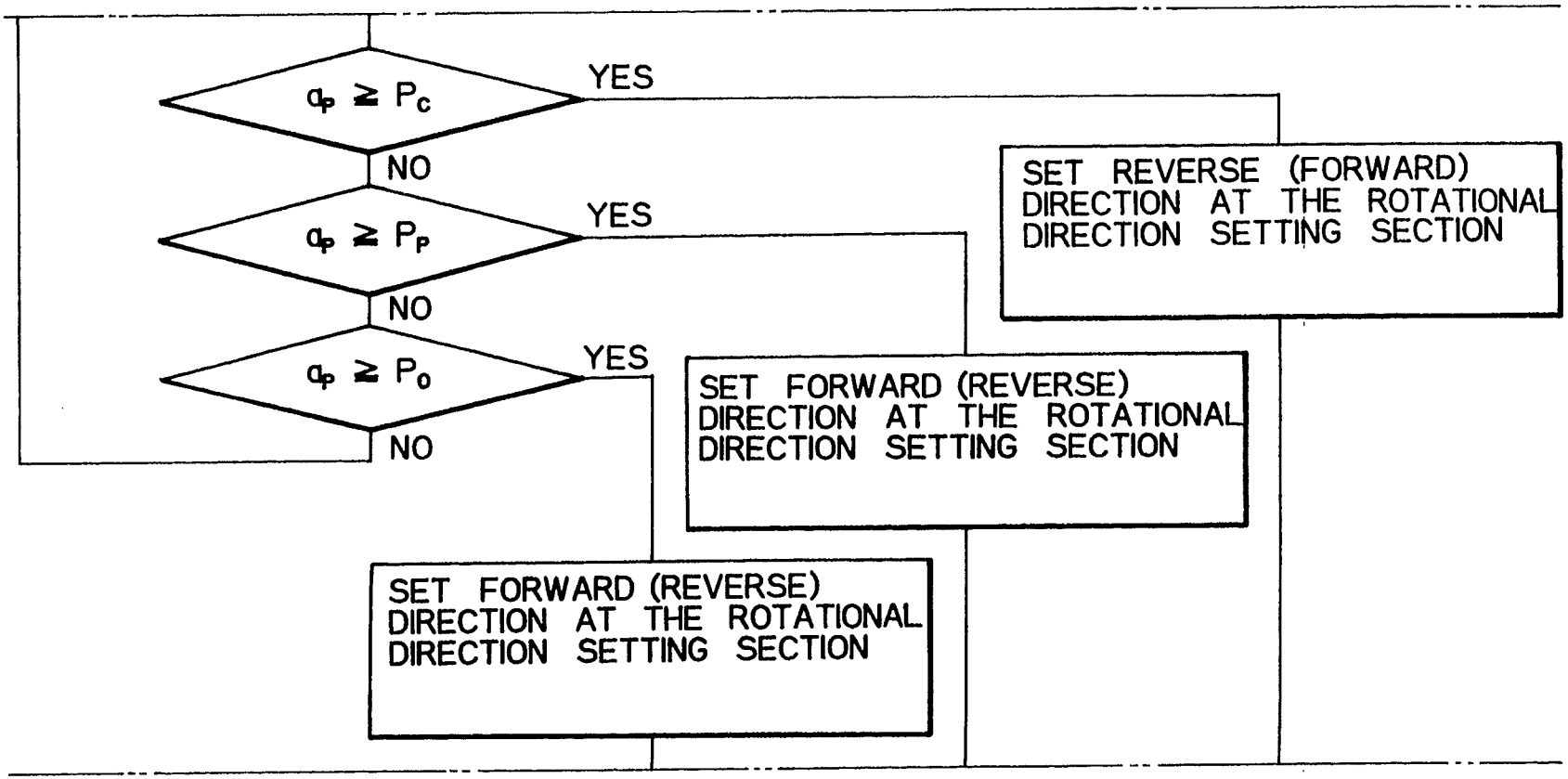
Figure 3C:
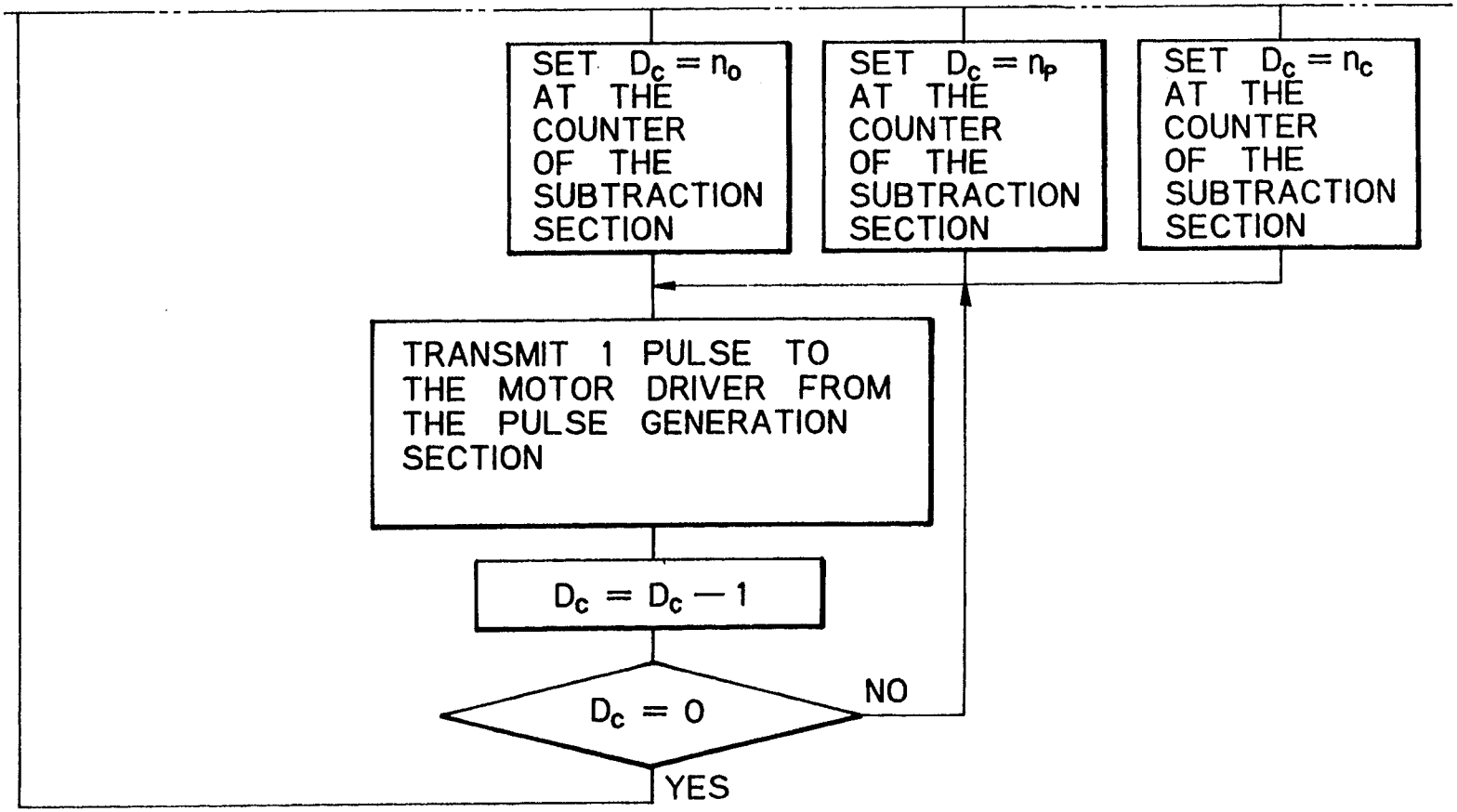
Figure 4:
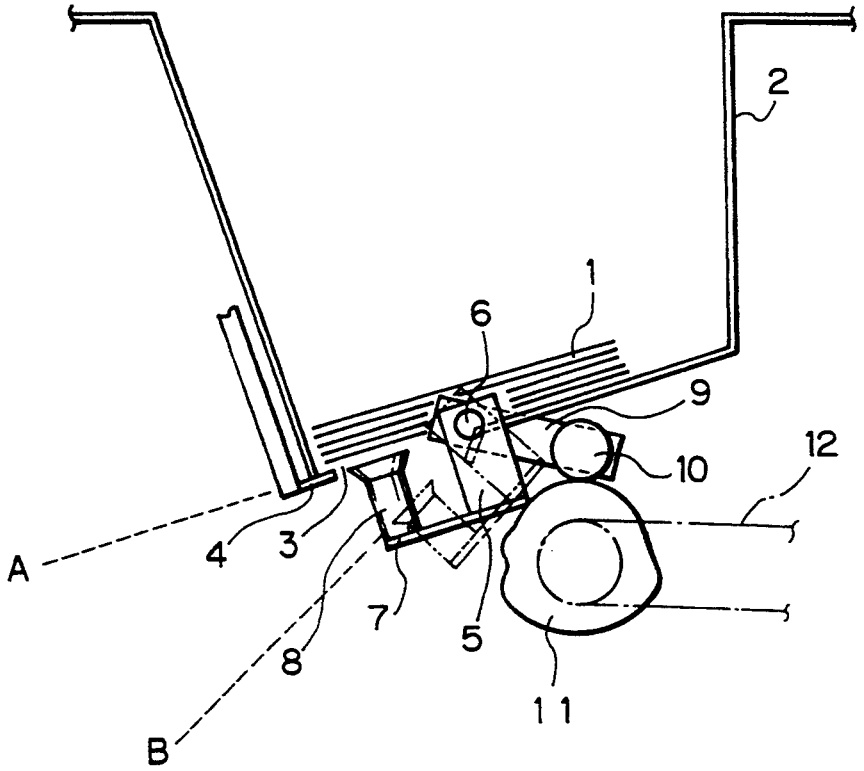
Fig. 4 PRIOR ART
FIG. 4 is a schematic constitutional drawing illustrating the enclosure feeding device for the enclosing and sealing apparatus according to a prior art.
Figure 5:
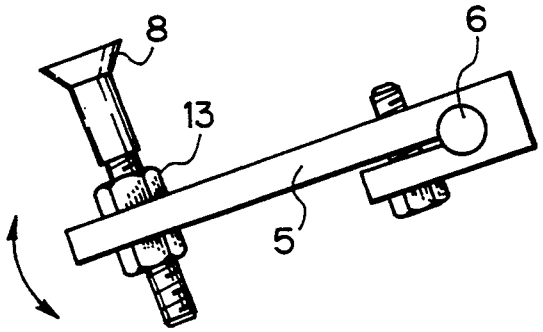
Fig. 5 PRIOR ART
FIG. 5 is a constitutional drawing showing the sucking cap adjustment mechanism for the enclosure feeding device according to a prior art.

The function of the present embodiment will now be explained by referring to the flow diagram in FIG. 3.

First of all, specified enclosures 1 are stacked in advance in the hopper 2. Depending on the thickness or quality of paper of the enclosures 1 thus stacked, the variable amount n in respect to the sucking position of the sucking cap 8 is input from the variable amount input section 28 whereby the close pulse number $n_c=N_c+n$, the pick pulse number $n_p=N_p+n$ and the open pulse number $n_o=N_o$ based on the variable amount n are stored respectively in the rotation pulse number storage section 26. In this instant, if a thick enclosure 1 is to be sucked, the variable amount n is set to the side (+) so that the sucking position of the sucking cap 8 may be located inwardly of the take-out opening 3 of the hopper 2. On the contrary, if a thin enclosure 1 is to be sucked, the variable amount n may be set to the side (−) so that the sucking position of the sucking cap 8 may be located outwardly of the take-out opening 3 of the hopper 2.

Nextly, the current tact position $a_p$ of the enclosing and sealing apparatus from the tact position generation section 31 is read by the operation commencing position comparison section 32 and the operation commencing positions $p_c$, $P_p$ and $P_o$ respectively of the close, pick and open operations sent from the operation commencing position storage section 27 are read, such that the current tact position $a_p$ and the respective operation commencing position are compared to decide if the respective operation can be commenced.

If $a_p \geqq P_c$, an operation commencement enable signal is output from the operation commencing position comparison section 32 to the rotation pulse number selection section 30 and also an operation commencement enable signal is output to the rotational direction setting section 37 which, in turn, outputs to the motor driver 35 a signal to set the rotational direction of the drive motor 18 for sucking operation to the specified direction.

When the operation commencement enable signal is input to the rotation pulse number selection section 30, the close operation pulse number $n_c$ is read by the rotation pulse number selection section 30 from the rotation pulse number storage section 26 and the counter $D_c$ of the subtraction section 33 is set as $D_c=n_c$. And a signal corresponding to 1 pulse is sent to the pulse generation section 36 from the subtraction section 33 and a pulse signal for each 1 pulse is output to the motor driver 35 by the pulse generation section 36 while a signal for subtracting each 1 pulse is output to the subtraction section 33. In this way, the drive motor 18 for sucking operation is driven by 1 pulse by the motor driver 35 in the rotational direction output from the rotational direction setting section 37 and the pulse number in the counter is subtracted by the subtraction section 33 to $D_c=D_c-1$. Signals are again output to the pulse generation section 36. The above-described operations are repeated until the counter of the subtraction section comes to $D_c=0$ when operations are terminated. In this way, the sucking position may be set by the close pulse number $n_c$. It is to be noted that according to the present embodiment, since a dedicated drive motor 18 for sucking operation is provided to activate the sucking cap 8, the positional adjustment of the sucking cap 8 may be independently attained by setting the drive pulse number of the drive motor 18 for sucking operation.

Subsequently, when the current tact position $a_p$ is read again by the operation commencing position comparison section 32 and if $a_p \geqq P_p$, then the feeding position is set by pick operation in a similar manner to the previous operation. If $a_p \geqq P_o$, the basic position of open operation is set. Setting of operation positions of the sucking cap 8 depending on the particular variable amount n is completed through the respective operations as above described.

As described above the variable amount is inputted, the drive motor 18 for sucking operation will be energized so that the rocking arm 5 may be rocked by way of the output pulley 19, the timing belt 20 respectively and the drive pulley 17 and the sucking cap 8 located at the basic position will be moved to the position for sucking an enclosure 1. Then, by opening the electromagnetic value 15 of the vacuum pipe 16, the sucking cap 8 is activated to execute sucking operation and suck the lowermost enclosure 1 in the hopper 2. Subsequently, the rocking arm 5 is rocked in the anti-clockwise direction as viewed in the drawing to pick up the enclosures 1 one by one from the take-out opening 3 of the hopper 1.

Then, when the sucking cap 8 has been moved to the feeding position, the pressure contact roller 21 is pressed against the feed roller 21 to sandwich the enclosure 1 between the pressure contact roller 22 and the feed roller 21. Under this condition, sucking by the sucking cap 8 of the enclosure 1 is released and the sucking cap 8 is moved to the basic position in order to prevent the sucking cap 8 from contacting with the enclosure 1. Subsequently, the feed roller 21 is rotated to transfer the enclosure 1 to the feeding position.

The sucking cap 8 is moved again to the sucking position and by repeating the above-described operations, the enclosures 1 contained in the hopper 2 may be taken out and fed successively.

According to the present embodiment, if a thick enclosure 1 is to be sucked, since the sucking position of the sucking cap 8 may be automatically located inwardly of the take-out opening 3 of the hopper 2 by setting the variable amount n to the side of (+), sucking may take place with the sucking cap 8 forcibly pressed against the thick enclosure 1. On the other hand, if a thin enclosure 1 is to be sucked, since the sucking position of the sucking cap 8 may be automatically located outwardly of the take-out opening 3 of the hopper 2 by setting the variable amount n to the (−) side, sucking may take place with the thin enclosure 1 slightly spaced from the sucking cap 8. Furthermore, the variable amount n also is inputted based on quality of paper of enclosure 1.

Accordingly, since the sucking position of the sucking cap 8 may be automatically adjusted through a simple operation of inputting a particular variable amount according to the present embodiment, the sucking cap 8 may be adjusted to a propel sucking position corresponding to the thickness or material of an enclosure 1, whereby adjustment work efficiency may be significantly enhanced. As a consequence, an accurate sucking operation is made available in conformity with the thickness of enclosures 1 and also proper feed of enclosures 1 is made possible.

It is to be understood that the present invention should not be limited to the illustrated embodiments but various changes and modifications are possible as required.

As explained above, according to the enclosure feeding device for the enclosing and sealing apparatus according to the present invention, a simple operation of inputting a specified variable amount from the variable amount input section of the control unit allows the sucking cap to be automatically adjusted to a proper sucking position in conformity with the thickness of enclosures, thereby significantly enhancing the adjustment work efficiency. As a consequence, an accurate sucking operation may be provided in conformity with the thickness of enclosures and a proper feeding operation of enclosures may also the ensured.

What is claimed is:

1. In an enclosing and sealing apparatus including a rocking arm having a sucking cap attached to the tip end thereof and rockably mounted adjacent to a hopper for stacking and storing enclosures, and a feeder mechanism disposed adjacent to said sucking cap, said enclosures in said hopper being sucked one by one by said sucking cap under a rocking movement of said rocking arm and being fed to said feeder mechanism, said enclosures which have been sucked and carried by said sucking cap being conveyed by said feeder mechanism to a predetermined station an enclosure feed apparatus, comprising:

a drive motor for rockably moving said rocking arm;

an input section for inputting a set value to so indicate a desired position where said sucking cap is operated so as to accommodate the thickness or quality of paper of said stacked enclosures; and a control unit adapted to drive said drive motor according to said set value to so rockably move said cap to assume a position where said sucking cap is operated so as to accommodate the thickness or quality of paper for said enclosures, thus sucking said enclosures one by one.

2. In an enclosing and sealing apparatus including a feeder mechanism for feeding enclosures, a hopper for stacking and storing said enclosures to be fed to said feeder mechanism, a rocking arm having a sucking cap attached to the tip end thereof and rockably mounted at least movable to a close position where said sucking cap sucks said enclosures stacked in said hopper and to a pick position where said sucked enclosures is fed to said feeder mechanism, said enclosures in said hopper being sucked one by one by said sucking cap and being fed to said feeder mechanism under rocking movement of said rocking arm to said close and pick positions, said enclosures which have been sucked and carried by said sucking cap being conveyed by said feeder mechanism to a predetermined station an enclosure feed apparatus, comprising:

a drive motor for rockably moving said rocking arm;

an input for inputting a set value to so indicate a said close position and/or said pick position so as to accommodate the thickness or quality of paper of the stacked enclosures; and a control unit adapted to drive said drive motor according to said set value to rockably move said cap to assume said close position and/or said pick position so as to accommodate the thickness or quality of paper for said enclosures, thus sucking said enclosures one by one.

3. In an enclosing and sealing apparatus including a rocking arm having a sucking cap attached to the tip end thereof and rockably mounted adjacent a hopper for stacking and storing enclosures, and a feeder mechanism disposed adjacent said sucking cap, said enclosures in said hopper being sucked one by one by said sucking cap under rocking movement of said rocking arm and being fed to said feeder mechanism, said enclosures which have been sucked and carried by said sucking cap being conveyed by said feeder mechanism to a predetermined station, an enclosure feed apparatus comprising:

a drive motor for rockably moving said rocking arm;

a variable amount input means for inputting variable amounts to so indicate a desire position where said sucking cap is sucked so as to accommodate the thickness or quality of paper of said sucked enclosures;

a memory means for storing a close pulse number and a pick pulse number according to said variable amounts;

an operation starting position comparator means for detecting a starting timing of each of a close operation and a pick operation according to an angle at which a drive motor is rotated; and a control unit adapted to rotate said drive motor in the direction of said enclosures by said close pulse number when said operation starting position comparator means detects possibility of close operation starting and rotate said drive motor in the direction opposite to said enclosures by said pick pulse number when said operation starting position comparator means detects possibility of open operation starting.

4. A combination in accordance with claim 3 wherein said operation starting position comparator means is adapted to compare a prestored close operation starting and pick operation starting positions and a present tact position according to an angle at which said drive motor is rotated for determining each of operation starting positions.

5. A combination in accordance with claim 3 wherein said memory means prestores a predetermined open pulse number, said operation starting position comparator means detects a starting timing of said open operation according to an angle at which said drive motor is rotated, said control unit rotates said drive motor by numbers corresponding to said open pulse number in the direction opposite to said enclosures.

6. A combination in accordance with claim 5 characterized in that:

n is the variable amount, $n_c$ is the close pulse number equal to $N_c+n$ ($N_c$ being an initial value of the close pulse), $n_p$ is the pick pulse number equal to $N_p+n$ ($N_p$ being an initial value of the pick pulse), $n_o$ is the open pulse number equal to $N_o$ ($N_o$ being an initial value of the open pulse)

wherein $n_c=n_p+n$, $N_c=N_p+N_o$.

7. A combination in accordance with claim 4 wherein said operation starting position comparator means is adapted to compare a prestored open operation starting position to the present tact position according to an angle at which said drive motor is rotated for determining open operation starting position.

8. A combination in accordance with claim 7 characterized in that:

n is the variable amount, $n_c$ is the close pulse number equal to $N_c+n$ ($N_c$ being an initial value of the close pulse), $n_p$ is the pick pulse number equal to $N_p+n$ ($N_p$ being an initial value of the pick pulse), $n_o$ is the open pulse number equal to $N_o$ ($N_o$ being an initial value of the open pulse)

wherein $n_c=n_p+n_o$, $N_c=N_p+N_o$.

9. In a method of enclosing and sealing including the steps of providing a rocking arm having a sucking cap attached to the tip end thereof and rockably mounted adjacent a hopper for stacking and storing enclosures, and a feeder mechanism disposed adjacent said sucking cap, of rockably moving said rocking arm to suck said enclosures in said hopper one by one by said sucking cap for feeding said enclosures to said feeder mechanism, and conveying said enclosures which have been sucked and carried by said sucking cap by means of said feeder mechanism to a predetermined station, an enclosure feed method, comprising the steps of:

providing a drive motor for rockably moving said rocking arm;

inputting a set value to so indicate a desired position where said sucking cap is sucked as to accommodate the thickness or quality of paper of said stacked enclosures; and storing a close pulse number, a pick pulse number, and open pulse number, respectively according to said variable amounts;

detecting a starting timing of each of a close operation, a pick operation, and an open operation according to an angle at which a drive motor is rotated, rotating said drive motor in the direction of said enclosures by number corresponding to said close pulse number when said detecting step possibility of close operation starting and rotate said drive motor in the direction opposite to said enclosures by number corresponding to said pick pulse number when said detecting step detects possibility of pick operation starting and rotating said drive motor in the directsion opposite to said enclosures by number corresponding to said open pulse number when said detecting step detects possibility of open operation starting.

* * * * *

UNITED STATES PATENT AND TRADEMARK OFFICE

CERTIFICATE OF CORRECTION

PATENT NO. : 5,366,214
DATED : November 22, 1994
INVENTOR(S) : Koki SATO

It is certified that error appears in the above-indentified patent and that said Letters Patent is hereby corrected as shown below:

On the Title Page, item [73], change "Chofu" to --Chofu-shi, Tokyo--.

At column 8, line 36, after "station" insert --,-- (comma).

At column 9, line 6, change "n" to --$n_o$--.

At column 10, line 20, after "method" delete --,-- (comma).

At column 10, line 42, change "directsion" to --direction--.

Signed and Sealed this

Second Day of May, 1995

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,366,214
DATED : November 22, 1994
INVENTOR(S) : Koki SATO

It is certified that error appears in the above-indentified patent and that said Letters Patent is hereby corrected as shown below:

On the Title Page, item [73], change "Chofu" to --Chofu-shi, Tokyo--.

At column 8, line 36, after "station" insert --,-- (comma).

At column 9, line 38, change "n" to --$n_o$--.--

At column 10, line 20, after "method" delete --,-- (comma).

At column 10, line 42, change "directsion" to --direction--.

This certificate supersedes Certificate of Correction issued May 2, 1995.

Signed and Sealed this

Seventh Day of November, 1995

*Attest:*

*Attesting Officer*

Bruce Lehman

BRUCE LEHMAN

*Commissioner of Patents and Trademarks*